US009541874B2

(12) United States Patent
Akatsuka et al.

(10) Patent No.: US 9,541,874 B2
(45) Date of Patent: Jan. 10, 2017

(54) FIXING DEVICE AND IMAGE FORMING APPARATUS HAVING A MOVABLE PRESSING UNIT

(71) Applicant: FUJI XEROX CO., LTD., Tokyo (JP)

(72) Inventors: Masahiro Akatsuka, Kanagawa (JP); Hideki Sato, Kanagawa (JP); Jun Sawamura, Kanagawa (JP); Haruhiko Nishida, Kanagawa (JP); Yoshiro Konishi, Kanagawa (JP); Yasuhiro Kato, Kanagawa (JP); Takayuki Ukawa, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/841,837

(22) Filed: Sep. 1, 2015

(65) Prior Publication Data

US 2016/0274518 A1 Sep. 22, 2016

(30) Foreign Application Priority Data

Mar. 19, 2015 (JP) ..... 2015-055912

(51) Int. Cl.
*G03G 15/20* (2006.01)

(52) U.S. Cl.
CPC ..... *G03G 15/2085* (2013.01)

(58) Field of Classification Search
CPC ..... G03G 15/2085; G03G 15/2017; G03G 15/2067; G03G 15/2089; G03G 15/2028
USPC ..... 399/329
See application file for complete search history.

(56) References Cited

U.S. PATENT DOCUMENTS

| | | | | |
|---|---|---|---|---|
| 7,953,361 | B2 | 5/2011 | Obata et al. | |
| 8,543,045 | B2 | 9/2013 | Arikawa et al. | |
| 2012/0251206 | A1* | 10/2012 | Nakamura | G03G 15/206 399/329 |
| 2012/0275835 | A1* | 11/2012 | Kuroda | G03G 15/2085 399/329 |
| 2013/0170878 | A1* | 7/2013 | Kuroda | G03G 15/2053 399/329 |

(Continued)

FOREIGN PATENT DOCUMENTS

| | | | |
|---|---|---|---|
| JP | 2008-076637 | A | 4/2008 |
| JP | 2008-233133 | A | 10/2008 |

(Continued)

*Primary Examiner* — Billy Lactaoen
*Assistant Examiner* — Arlene Heredia Ocasio
(74) *Attorney, Agent, or Firm* — Sughrue Mion, PLLC

(57) ABSTRACT

A fixing device includes a heating unit, an endless belt body that follows rotation of the heating unit, and a pressing unit that faces the heating unit with the endless belt body interposed therebetween. The pressing unit includes a retaining body that rotatably retains the endless belt body, a pressing-area-forming portion that is a part of the retaining body, and a pressing member provided on an upstream side of the retaining body with respect to the pressing-area-forming portion in a direction of rotation of the endless belt body, the pressing member being a metal plate that is bent along a line extending in a longitudinal direction thereof. The pressing unit is movable relative to the heating unit between a position where a pressing area is formed by the pressing-area-forming portion and the pressing member and a position where the pressing area is formed by the pressing member.

5 Claims, 7 Drawing Sheets

(56) References Cited

U.S. PATENT DOCUMENTS

2013/0279957 A1* 10/2013 Kasama ..... G03G 15/2085
399/329

FOREIGN PATENT DOCUMENTS

| | | | | |
|---|---|---|---|---|
| JP | 2008233133 | A | * | 10/2008 |
| JP | 2010-282237 | A | | 12/2010 |
| JP | 2012-008394 | A | | 1/2012 |
| JP | 2014-048487 | A | | 3/2014 |

* cited by examiner

FIXING DEVICE AND IMAGE FORMING APPARATUS HAVING A MOVABLE PRESSING UNIT

CROSS-REFERENCE TO RELATED APPLICATIONS

This application is based on and claims priority under 35 USC 119 from Japanese Patent Application No. 2015-055912 filed Mar. 19, 2015.

BACKGROUND

Technical Field

The present invention relates to a fixing device and an image forming apparatus.

SUMMARY

According to an aspect of the invention, there is provided a fixing device including a heating unit, an endless belt body that rotates by following rotation of the heating unit, and a pressing unit that faces the heating unit with the endless belt body interposed between the pressing unit and the heating unit. The pressing unit includes a retaining body that retains the endless belt body while allowing the endless belt body to rotate, a pressing-area-forming portion that is a part of the retaining body, and a pressing member that is provided on an upstream side of the retaining body with respect to the pressing-area-forming portion in a direction of rotation of the endless belt body, the pressing member being made of a metal plate that is bent along a line extending in a longitudinal direction of the plate. The pressing unit is movable relative to the heating unit between a position where a pressing area that is formed when the pressing unit is pressed toward the heating unit is formed by the pressing-area-forming portion and the pressing member and a position where the pressing area is formed by the pressing member.

BRIEF DESCRIPTION OF THE DRAWINGS

An exemplary embodiment of the present invention will be described in detail based on the following figures, wherein.

DETAILED DESCRIPTION

Exemplary Embodiment

Figure 1:
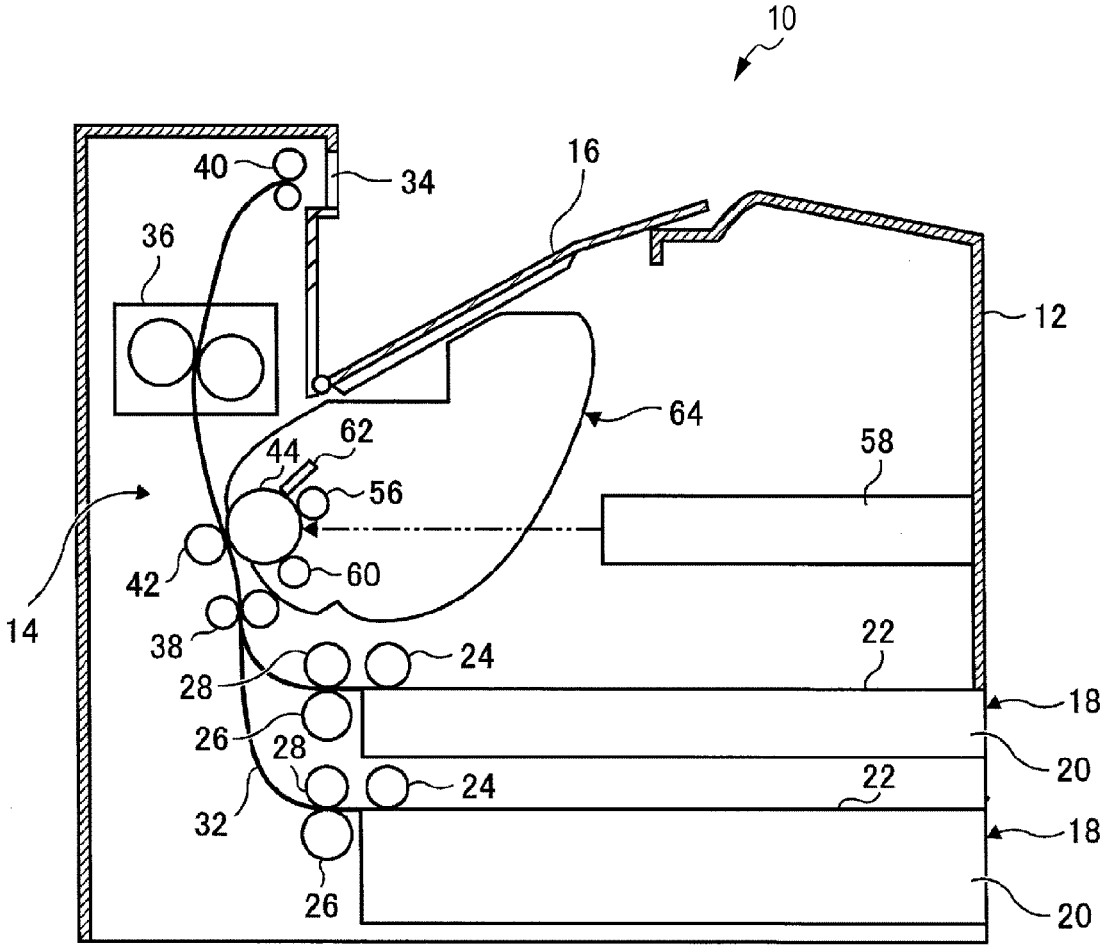
FIG. 1 is a sectional side view of an image forming apparatus according to the exemplary embodiment.

Referring to FIGS. 1 to 7C, an image forming apparatus 10 according to an exemplary embodiment of the present invention will now be described. As illustrated in FIG. 1, the image forming apparatus 10 according to the exemplary embodiment includes an image-forming-apparatus body 12, in which at least one medium feeding unit 18, an image forming device 14, and a fixing device 36 are provided. The image-forming-apparatus body 12 has a discharge port 34 provided at the top thereof. The medium feeding unit 18, the image forming device 14, the fixing device 36, and the discharge port 34 are connected to one another by a transport path 32 along which a recording medium 130 as a transfer object, such as recording paper, is transported. The image forming apparatus 10 according to the exemplary embodiment employs a free belt nip fusing (FBNF) technology in which a pressing unit 76 included in the fixing device 36 operates under two different levels of pressing forces in forming a pressing area, as to be described below. The individual elements will now be described.

The medium feeding unit 18 includes a medium-feeding-unit body 20, a medium cassette 22 that contains recording media 130 as transfer objects, a pickup roller 24 that picks up any of the recording media 130 stacked in the medium cassette 22, and a combination of a feed roller 28 and a retard roller 26 that separates one of the recording media 130 from the others and feed the one recording medium 130 toward the downstream side. With the rotation of the pickup roller 24 and the rotation of the feed roller 28 and the retard roller 26, the recording media 130 stacked in the medium cassette 22 are transported one by one to a pair of registration rollers 38, to be described below, along the transport path 32. The medium cassette 22 is detachably attached to the medium-feeding-unit body 20. The number of medium feeding units 18 may be one or two or more. In the exemplary embodiment illustrated in FIG. 1, two medium feeding units 18 are provided.

The image forming device 14 employs an electrophotographic method and includes an image carrier 44 including a photoconductor, a charging device 56 including a charging roller or the like and that uniformly charges the image carrier 44, an optical drawing device 58 that draws, with light, a latent image on the image carrier 44 charged by the charging device 56, a developing device 60 including a developing roller and that visualizes, with toner, the latent image drawn on the image carrier 44 by the optical drawing device 58, a transfer device 42 including a transfer roller or the like and that transfers a toner image obtained through the visualization of the latent image by the developing device 60 to the recording medium 130, a cleaning device 62 that removes toner remaining on the image carrier 44, and the fixing device 36 that fixes the toner image transferred to the recording medium 130 by the transfer device 42.

The optical drawing device 58 is, for example, a scanning laser exposure device and forms a latent image on the image carrier 44 by scanning laser light over a process cartridge 64 to be described below. The optical drawing device 58 may alternatively be a light-emitting-diode (LED) light source, a surface emitting laser, or the like.

The process cartridge 64 is a unit including the image carrier 44, the charging device 56, the developing device 60, and the cleaning device 62 and is exchangeable as the unit. When a discharge portion 16 is opened, the process cartridge 64 is removable from the image-forming-apparatus body 12.

The transport path 32 extends from the pickup roller 24 of the medium feeding unit 18 provided at the bottom of the image-forming-apparatus body 12 to the discharge port 34 provided at the top of the image-forming-apparatus body 12, and allows the recording medium 130 to pass therethrough. The transport path 32 includes a portion extending inside the image-forming-apparatus body 12 and substantially vertically from the pickup roller 24 of the medium feeding unit 18 at the bottom to the fixing device 36.

The transfer device 42 and the image carrier 44 are provided on the upstream side of the transport path 32 with respect to the fixing device 36, and the pair of registration rollers 38 are provided on the upstream side of the transport path 32 with respect to the transfer device 42 and the image carrier 44. Furthermore, a pair of discharge rollers 40 are provided near the discharge port 34 at the end of the transport path 32.

Hence, a recording medium 130 that is picked up from the medium cassette 22 of the medium feeding unit 18 and is separated from the other recording media 130 by the retard roller 26 and the feed roller 28 is guided into the transport path 32, is temporarily stopped at the pair of registration rollers 38, and is allowed to pass through a position between the transfer device 42 and the image carrier 44 at an appropriate timing, whereby a toner image is transferred to the recording medium 130. The toner image thus transferred to the recording medium 130 is fixed by the fixing device 36. The recording medium 130 having the fixed toner image is discharged from the discharge port 34 to the discharge portion 16 by the pair of discharge rollers 40.

Figure 2:
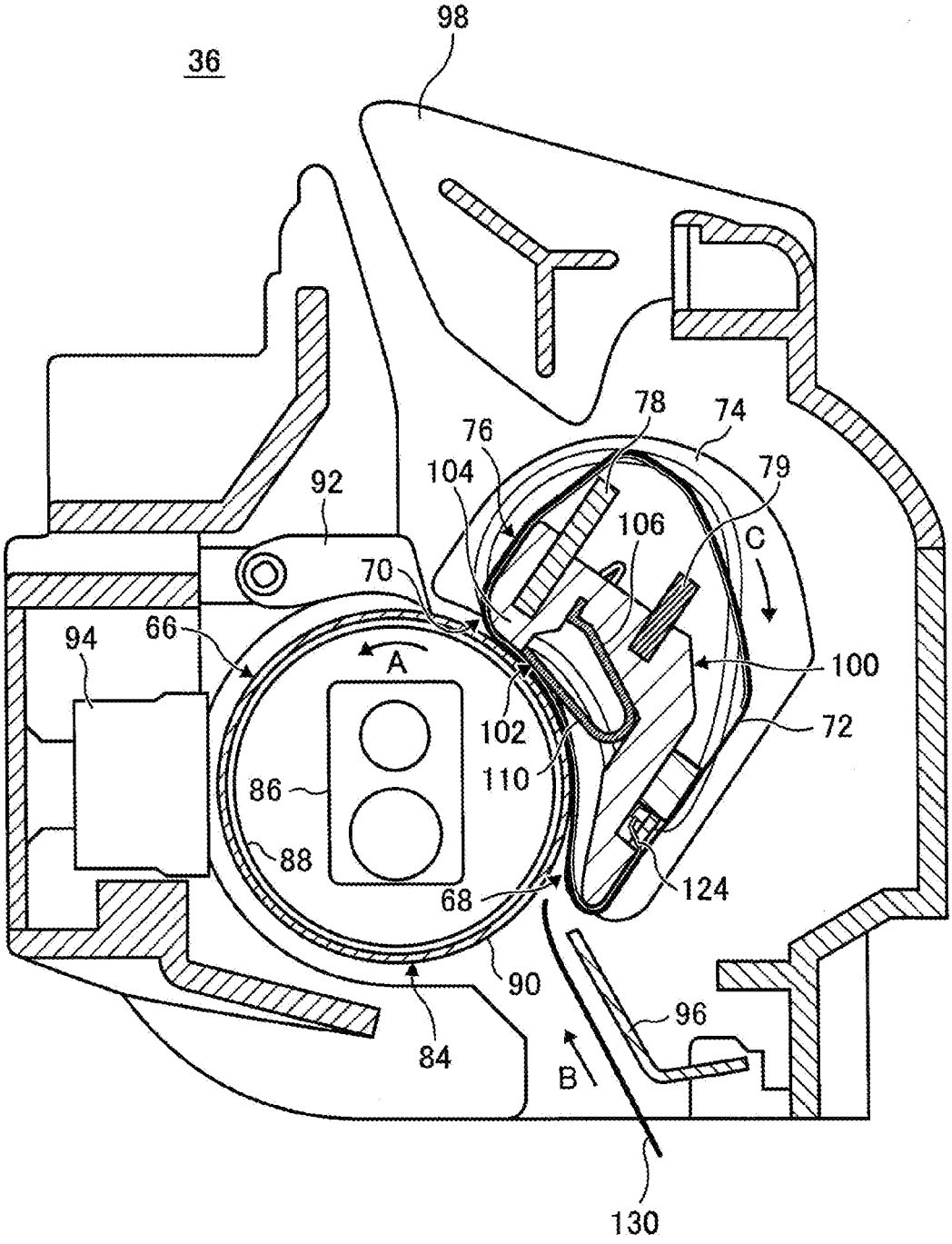
FIG. 2 is a sectional side view of a fixing device according to the exemplary embodiment.
Figure 3:
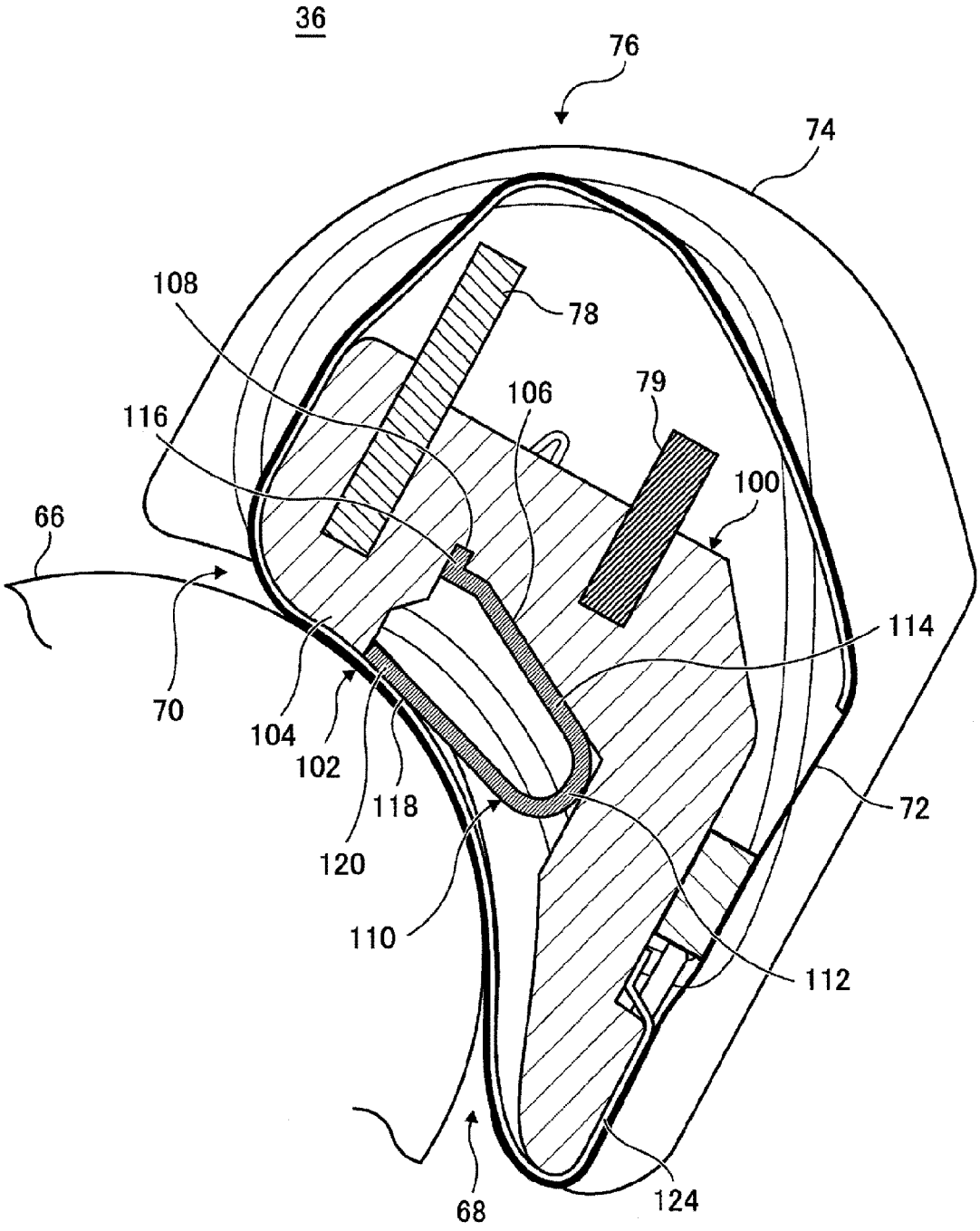
FIG. 3 is an enlarged sectional view illustrating a part of the fixing device according to the exemplary embodiment.

Referring to FIGS. 2 and 3, the fixing device 36 includes a heating roller 66 as a heating unit, an endless belt 72 as an endless belt body, a guide member 74 that guides the endless belt 72 while allowing the endless belt 72 to rotate, and the pressing unit 76 provided on the inner side of the endless belt 72 and that is pressed against the heating roller 66 with the endless belt 72 interposed therebetween. The fixing device 36 is provided with a switching device 140 (see FIGS. 7A to 7C) that is capable of changing the position of the pressing unit 76 relative to the heating roller 66. Since the position of the pressing unit 76 is changeable, the state of pressing of the pressing unit 76 against the heating roller 66 in forming a pressing area 102 to be described below is changeable among a state established under a normal pressing force, a state established under a pressing force smaller than the normal pressing force, and a state established under no pressing force.

The heating roller 66 includes a round cylindrical roller portion 84 and a heater 86 provided on the inner side of the roller portion 84. The roller portion 84 is rotatably supported by heating-roller bearings (not illustrated) and is rotatable in a direction of arrow A (see FIG. 2). The roller portion 84 includes a core 88 made of a metal material such as iron, stainless steel, or aluminum, and a release layer 90 provided over or applied to the core 88. The roller portion 84 is a hard roller that does not include any elastic layer. The core 88 has, for example, an outside diameter of 25 mm and a thickness of 0.7 mm. The release layer 90 is made of an insulating material having high releasability, such as perfluoro-alkoxy-fluoro plastics (PFA), and has a thickness of, for example 20 μm.

Plural (five, for example) releasing picks 92 are provided in contact with the roller portion 84. The heater 86 includes, for example, two lamps. A thermostat 94 is provided facing the heating roller 66 and across the heating roller 66 from the endless belt 72.

The heating roller 66 may alternatively have a flared shape. A flared heating roller transports a recording medium while pulling the recording medium toward two ends thereof. In such a case, the area of the heating roller that is pressed by the pressing unit is wider, in a direction orthogonal to the axial direction of the heating roller, at two axial direction ends of the heating roller than in a central portion of the heating roller. Furthermore, since the two ends of the recording medium are first received by the heating roller, the occurrence of wrinkles or the like in the recording medium is suppressed.

The endless belt 72 runs between the heating roller 66 and the pressing unit 76 and rotates in a direction of arrow C (see FIG. 2) by following the rotation of the heating roller 66. The pressing unit 76 presses the endless belt 72 against the heating roller 66, whereby the pressing area 102 is formed. The toner image on the recording medium 130 is fixed in the pressing area 102. The endless belt 72 is made of, for example, synthetic resin such as polyimide and has a thickness of, for example, 75 μm, inclusive of a releasing layer made of PFA or the like that is provided over the surface thereof.

An inlet chute 96 is provided on the upstream side of the pressing area 102. The recording medium 130 transported in a direction of arrow B is guided by the inlet chute 96, whereby the leading end of the recording medium 130 is guided into the pressing area 102 (see FIG. 2). Furthermore, an outlet chute 98 is provided on the downstream side of the pressing area 102.

As illustrated in FIGS. 2 and 3, the pressing unit 76 includes a retaining body 100 provided on the inner side of the endless belt 72, a pressing member 110 attached to the retaining body 100, and fames 78 and 79 that supports the retaining body 100. Furthermore, a slide member 124 is provided between the endless belt 72 and the retaining body 100 so as to reduce the friction between the two.

The pressing area 102 is formed by the pressing unit 76 that is pressed toward the heating roller 66. Specifically, the pressing area 102 is formed by a pressing-area-forming portion 104 included in the retaining body 100 and the pressing member 110 attached to the retaining body 100, as to be described below. The pressing unit 76 is configured such that a combination of the retaining body 100 and the fames 78 and 79 causes the pressing-area-forming portion 104 and the pressing member 110, i.e., the entirety of the retaining body 100, to be pressed toward the heating roller 66.

The retaining body 100 is made of a resin material such as liquid crystal polymer (LCP) that is highly resistant to heat. As illustrated in FIGS. 2 and 3, the retaining body 100 has, on a side thereof facing the heating roller 66, the pressing-area-forming portion 104 that forms the pressing area 102, and a seating surface 106 to which the pressing member 110 that also forms the pressing area 102 in combination with the pressing-area-forming portion 104 is attached.

The pressing-area-forming portion 104 projects toward the heating roller 66 on the side of the retaining body 100 that faces the heating roller 66, and extends in the longitudinal direction of the retaining body 100. The pressing-area-forming portion 104 is provided on the downstream side of the retaining body 100 in the direction of rotation of the endless belt 72, that is, on the side of an exit 70 of the pressing area 102. Note that the pressing-area-forming portion 104 is a part of the retaining body 100.

The seating surface 106 is the bottom of a recess provided in the retaining body 100 and extends in the longitudinal direction of the retaining body 100. The seating surface 106 is provided on the upstream side of the retaining body 100 with respect to the pressing-area-forming portion 104 in the direction of rotation of the endless belt 72, that is, on the side of an entrance 68 of the pressing area 102. The seating surface 106 has a concavity 108 extending in the longitudinal direction of the retaining body 100.

Figure 4A:
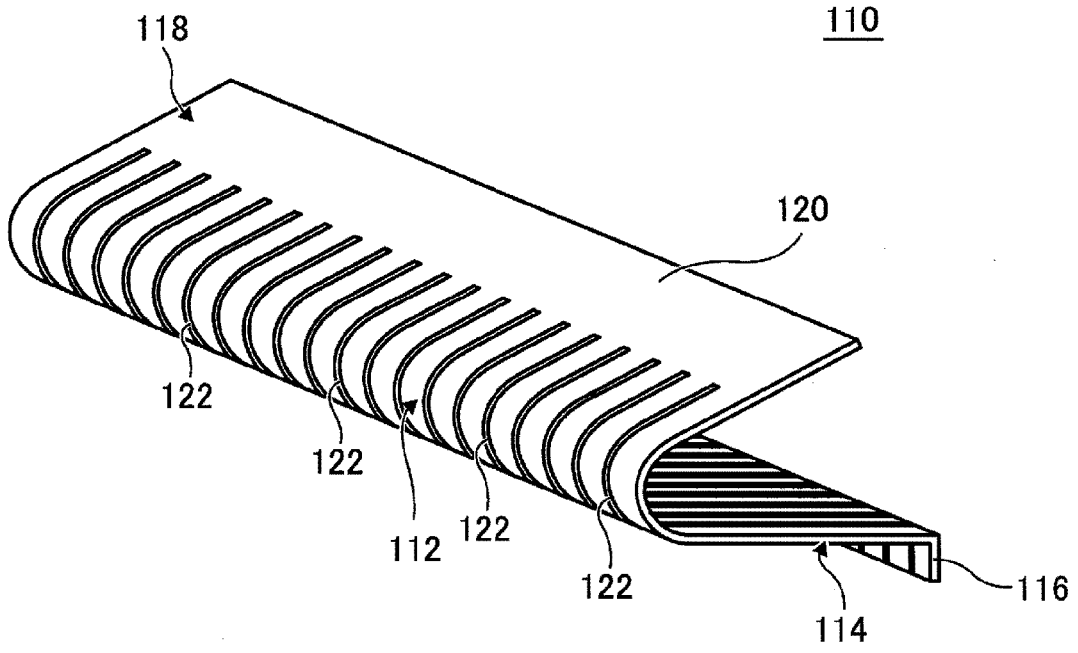
FIG. 4A is a perspective view of a pressing member according to the exemplary embodiment.
Figure 4B:
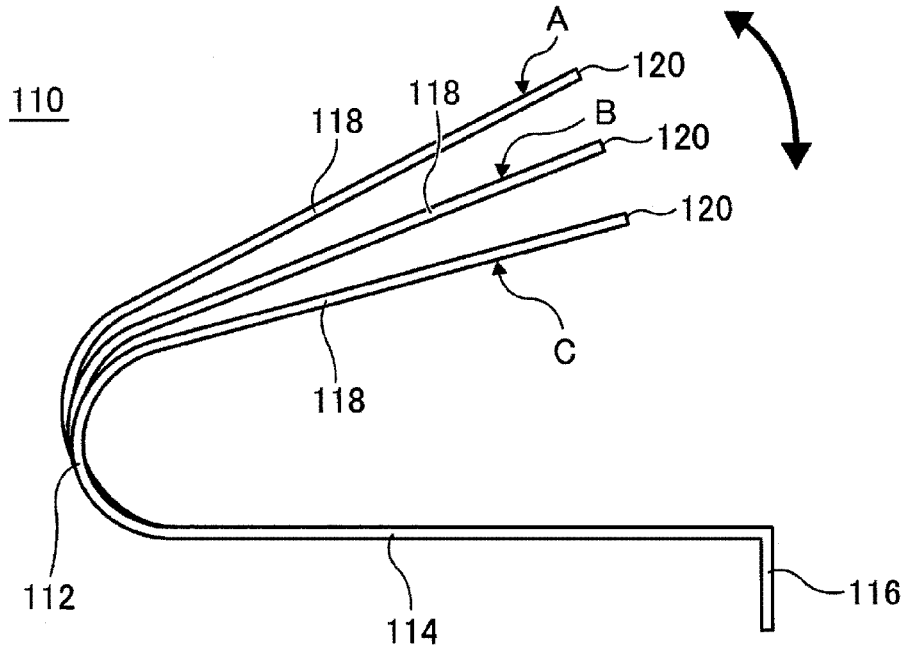
FIG. 4B is a side view of the pressing member and illustrates different states of the pressing member.

Referring to FIGS. 3, 4A, and 4B, the pressing member 110 is made of a metal plate whose longitudinal-direction length is substantially the same as the longitudinal-direction length of the retaining body 100, the metal plate being bent along a line extending in the longitudinal direction thereof so as to function as a spring that generates a repulsive force. The pressing member 110 includes a bent portion 112 at which the pressing member 110 is bent, a fixed portion 114 extending on one side of the pressing member 110 with respect to the bent portion 112 and fixed to the seating surface 106 of the retaining body 100, and a free end 118 extending on the other side of the pressing member 110 with respect to the bent portion 112 and turnable back and forth on the bent portion 112. When the pressing unit 76 is pressed toward the heating roller 66, the pressing member 110 is also pressed and is deformed such that the free end 118 thereof turns in accordance with the level of the pressing force. The deformation of the pressing member 110 generates a force with which the free end 118 is pressed toward the heating roller 66.

The fixed portion 114 of the pressing member 110 has a protrusion 116 at an end thereof opposite the bent portion 112. The protrusion 116 protrudes toward the seating surface 106 of the retaining body 100.

The pressing member 110 has plural grooves 122 each extending from the end of the fixed portion 114 through the bent portion 112 up to a position at a certain distance from a tip 120 of the free end 118. The presence of the grooves 122 allows the pressing member 110 to bend when pressed and to deform in conformity with the shape of the recording medium 130. Thus, the generation of a locally large pressing force is suppressed. Furthermore, since the pressing member 110 is made of metal, the heat capacity is smaller than that of a pressing member made of resin. Accordingly, for example, the start-up time of the fixing device 36 is shortened, and the efficient operation of the fixing device 36 is realized.

The pressing member 110 is attached to the seating surface 106 of the retaining body 100 such that the bent portion 112 at which the pressing member 110 is bent is positioned on the upstream side (the side of the entrance 68) in the direction of rotation of the endless belt 72. That is, the tip 120 of the free end 118 of the pressing member 110 faces the pressing-area-forming portion 104 of the retaining body 100. The pressing member 110 is attached to the seating surface 106 by being directly fitted into the recess provided in the retaining body 100, with the protrusion 116 of the pressing member 110 fitted into the concavity 108 of the seating surface 106.

FIG. 4B schematically illustrates different states A to C of the free end 118 of the pressing member 110 under respective levels of pressing forces. The pressing member 110 in the state A in FIG. 4B is under no pressing force, and the free end 118 is at the largest angle with respect to the fixed portion 114. The pressing member 110 in the state C in FIG. 4B is under the normal pressing force. The pressing member 110 in the state B in FIG. 4B is under the pressing force that is smaller than the normal pressing force. The angle of the free end 118 with respect to the fixed portion 114 is larger when the pressing member 110 is under the smaller pressing force than when the pressing member 110 is under the normal pressing force. That is, the position of the tip 120 of the free end 118 of the pressing member 110 is determined by the level of the pressing force applied to the pressing member 110.

As illustrated in FIG. 3, the slide member 124 is a sheet-like member and is provided between the endless belt 72 and the retaining body 100. The slide member 124 extends around a part of the retaining body 100 with a slide surface of the slide member 124 being in contact with the inner circumferential surface of the endless belt 72.

Referring to FIGS. 2 and 3, the guide member 74 is provided at each of two ends of the endless belt 72, i.e., at each of two ends of the pressing unit 76. The pressing unit 76 is supported by the guide members 74.

Referring to FIGS. 2 and 3, the fames 78 and 79 support the retaining body 100 while two ends of each of the fames 78 and 79 are supported by the respective guide members 74. With such a configuration, the retaining body 100 is pressed toward the heating roller 66. The ends of each of the fames 78 and 79 extend through the respective guide members 74 and are urged toward the heating roller 66 by urging members (not illustrated) such as springs. A journal member that supports the pressing unit 76 is continuous with a pressing lever 142 (see FIGS. 7A to 7C). The pressing lever 142 is urged by an urging member such that the pressing unit 76 is pressed toward the heating roller 66.

Now, a fixing process in which the fixing device 36 of the image forming apparatus 10 according to the exemplary embodiment fixes a toner image on a recording medium 130 will be described. The state of the fixing device 36 according to the exemplary embodiment during the fixing process is switchable between the state where the pressing unit 76 is pressed toward the heating roller 66 with the normal pressing force and the state where the pressing unit 76 is pressed toward the heating roller 66 with the pressing force smaller than the normal pressing force. The normal pressing force is generated when the pressing area 102 is formed by both the pressing-area-forming portion 104 of the retaining body 100, which press the pressing unit 76 toward the heating roller 66, and the pressing member 110. The pressing force smaller than the normal pressing force is generated when the pressing area 102 is formed by only the pressing member 110 attached to the retaining body 100, which presses the pressing unit 76 toward the heating roller 66.

The switching of the level of the pressing force applied to the pressing unit 76 between the normal pressing force and the smaller pressing force is implemented by, for example, using the pressing lever 142 of the switching device 140. The switching device 140 is provided at each of the two longitudinal-direction ends of the fixing device 36. When the pressing lever 142 is operated, the position of the pressing unit 76 relative to the heating roller 66 is changed.

Figure 7A:
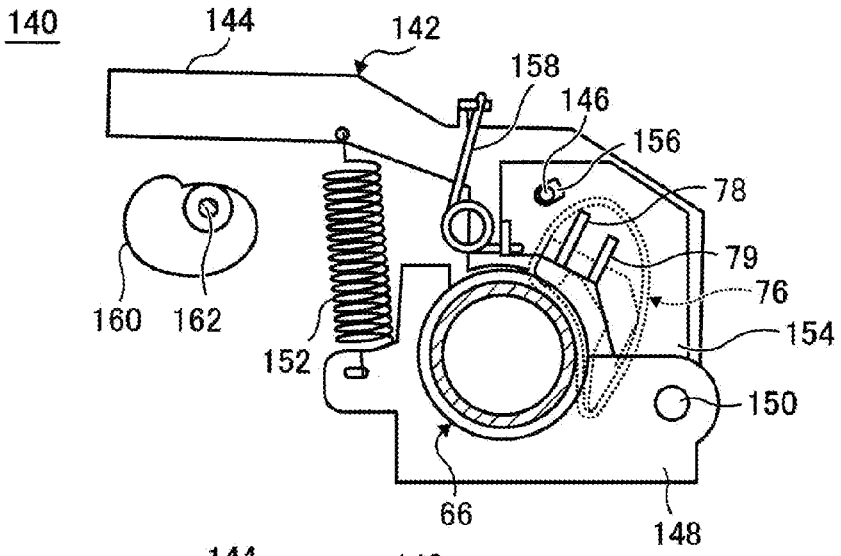
FIG. 7A is a sectional side view of a switching device according to the exemplary embodiment that is at a position for the normal pressing force.
Figure 7B:
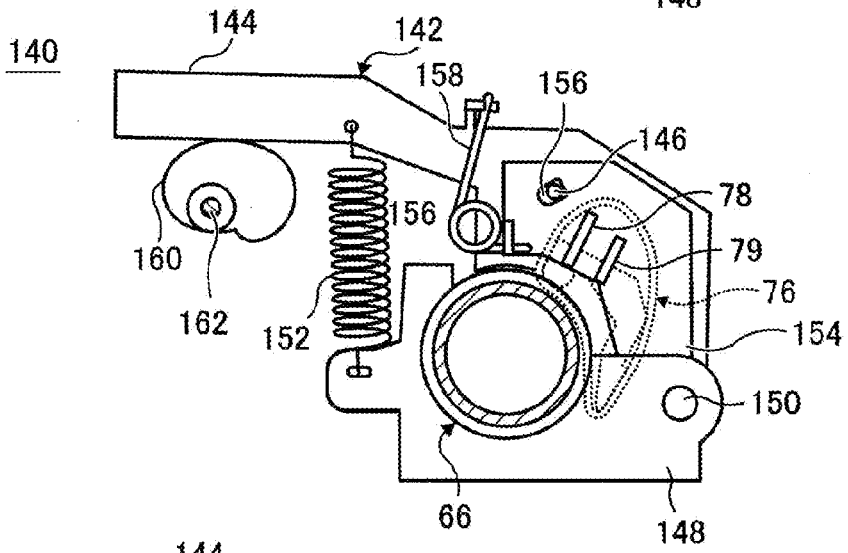
FIG. 7B is a sectional side view of the switching device that is at a position for the pressing force smaller than the normal pressing force.
Figure 7C:
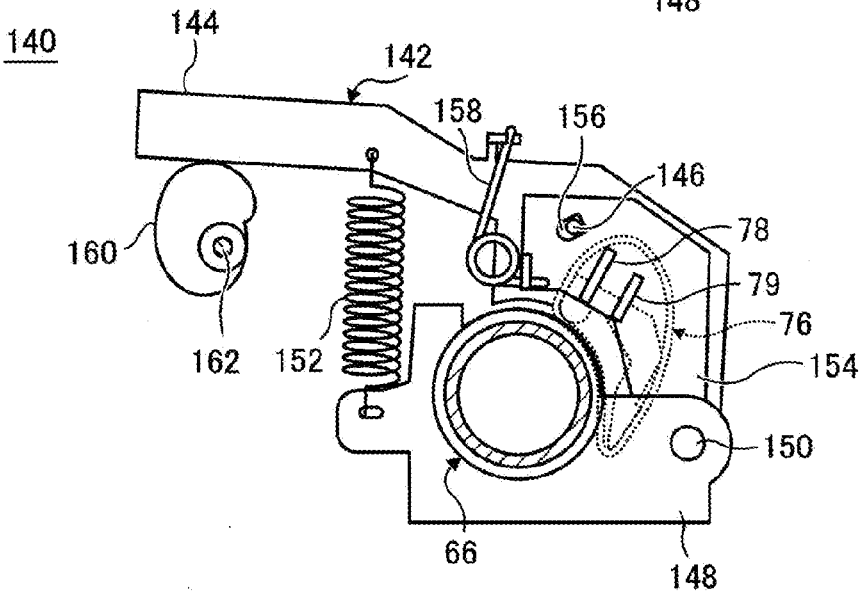
FIG. 7C is a sectional side view of the switching device that is at a position for no pressing force.

Specifically, referring to FIGS. 7A to 7C, the switching device 140 is provided at a position in the image-forming-apparatus body 12 where the fixing device 36 is provided. The switching device 140 includes a fixed frame 148, a swingable frame 154, and the pressing lever 142. The fixed frame 148 supports the heating roller 66. The swingable frame 154 is swingably attached to a shaft 150 extending through the fixed frame 148. The fames 78 and 79 of the pressing unit 76 are fixed to the swingable frame 154. The pressing lever 142 is attached to the shaft 150 of the fixed frame 148. The pressing lever 142 extends over the fames 78 and 79. The pressing lever 142 and the fames 78 and 79 are not fixed to each other.

The pressing lever 142 and the fixed frame 148 are connected to each other with a first spring member 152. The first spring member 152 exerts a pulling force that pulls the pressing lever 142 toward the fixed frame 148. Meanwhile, the pressing lever 142 and the swingable frame 154 are connected to each other with a second spring member 158. The second spring member 158 exerts a repulsive force that moves the pressing lever 142 and the swingable frame 154 away from each other. Furthermore, a projection 146 provided on the pressing lever 142 extends through an oblong hole 156 provided in the swingable frame 154, whereby the pressing lever 142 and the swingable frame 154 are in engagement with each other.

A flat cam 160 whose distance from the center to the circumference is not constant is provided on a rotating shaft 162 that is provided near an arm portion 144 of the pressing lever 142, i.e., on a side of the pressing lever 142 opposite the shaft 150. When the flat cam 160 is rotated about the rotating shaft 162 by a driving device (not illustrated) such as a motor, the arm portion 144 of the pressing lever 142 is pushed and the pressing lever 142 is moved. Thus, the level of the pressing force is changed.

To apply the normal pressing force to the pressing unit 76, the flat cam 160 and the pressing lever 142 of the switching device 140 are spaced apart from each other as illustrated in FIG. 7A. Accordingly, the pressing lever 142 is pulled toward the fixed frame 148 by the first spring member 152. Therefore, the fames 78 and 79 of the pressing unit 76 are pushed by the pressing lever 142, and the pressing unit 76 is pressed toward the heating roller 66. In this state, as illustrated in FIG. 3, the pressing unit 76 is at a position close to the heating roller 66, and the pressing area 102 is formed by both the pressing-area-forming portion 104 and the pressing member 110 of the pressing unit 76.

Figure 6:
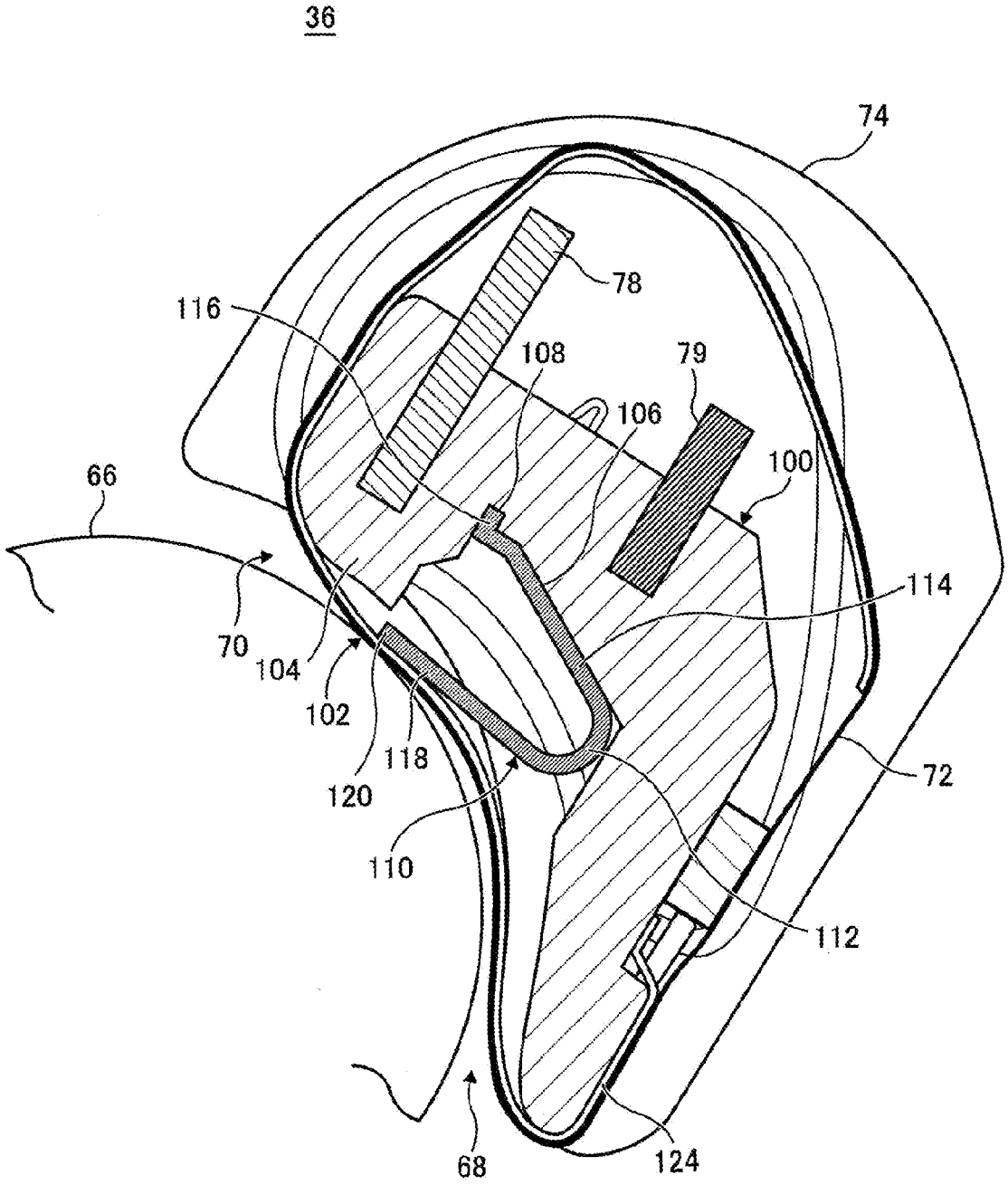
FIG. 6 is an enlarged sectional view illustrating the part of the fixing device according to the exemplary embodiment illustrated in FIG. 3 that is under a pressing force smaller than a normal pressing force.

To apply the pressing force smaller than the normal pressing force to the pressing unit 76, the flat cam 160 of the switching device 140 is rotated as illustrated in FIG. 7B, whereby the pressing lever 142 is rotated about the shaft 150 in a direction opposite to the direction in which the first spring member 152 pulls the pressing lever 142. Accordingly, the pressing lever 142 goes out of contact with the fames 78 and 79 of the pressing unit 76. Meanwhile, the second spring member 158 connecting the pressing lever 142 and the swingable frame 154 to each other presses the swingable frame 154 toward the heating roller 66. Hence, the fames 78 and 79 fixed to the swingable frame 154 are pushed, and the pressing unit 76 is pressed toward the heating roller 66. In this state, as illustrated in FIG. 6, the pressing unit 76 is at a position farther from the heating roller 66 than in the state where the normal pressing force is applied to the pressing unit 76, and the pressing area 102 is formed by only the pressing member 110 of the pressing unit 76.

To remove the pressing force applied to the pressing unit 76, the flat cam 160 of the switching device 140 is further rotated as illustrated in FIG. 7C, whereby the pressing lever 142 is further rotated from the position illustrated in FIG. 7B in the direction opposite to the direction in which the first spring member 152 pulls the pressing lever 142. Accordingly, the pressing lever 142 is moved away from the heating roller 66. Furthermore, with the movement of the pressing lever 142, the projection 146 provided on the pressing lever 142 moves in the oblong hole 156 provided in the swingable frame 154. When the projection 146 reaches the end of the oblong hole 156, the swingable frame 154 moves together with the pressing lever 142. Then, the pressing unit 76 moves together with the fames 78 and 79 fixed to the swingable frame 154. Thus, the pressing unit 76 is spaced apart from the heating roller 66.

Figure 5:
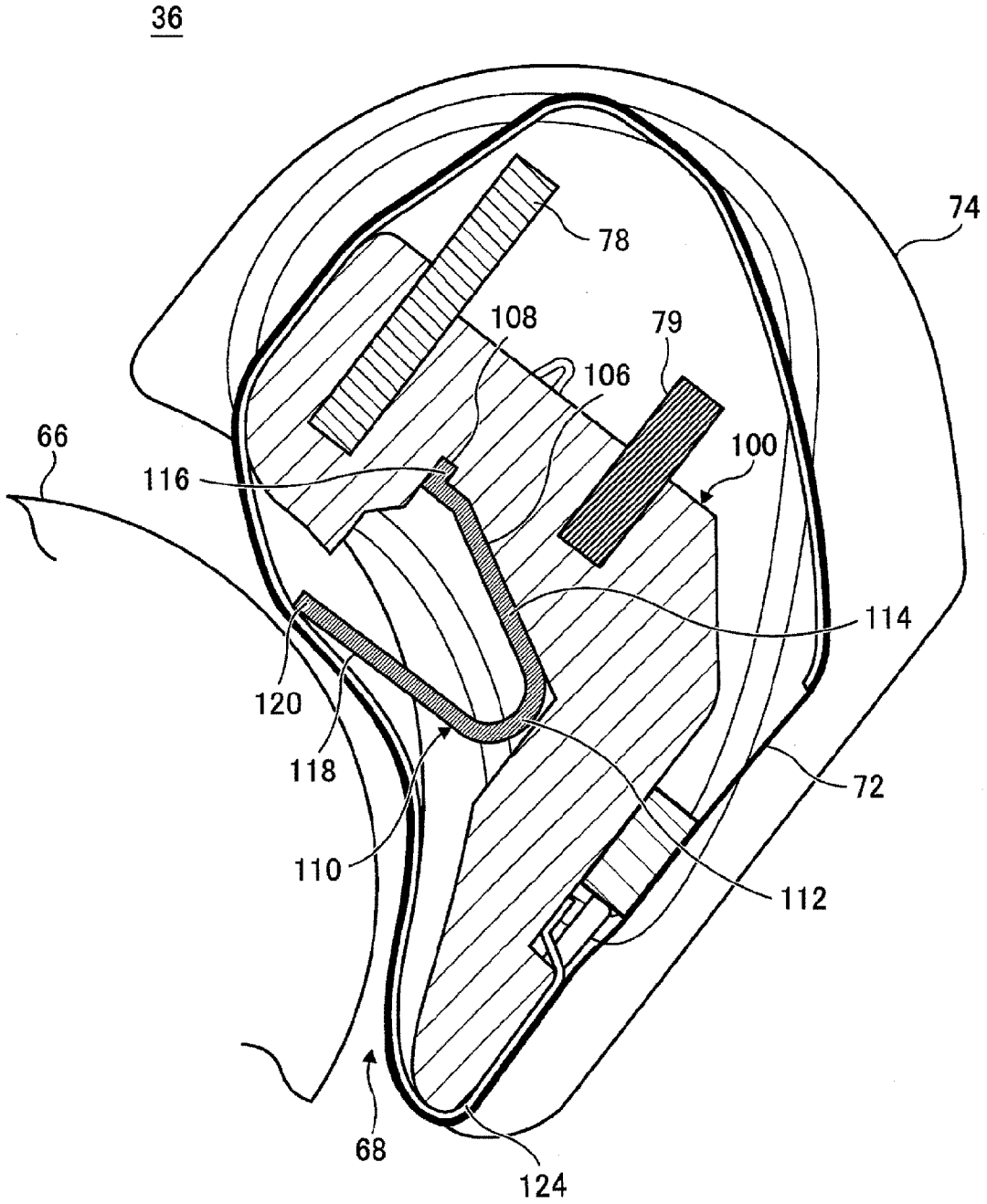
FIG. 5 is an enlarged sectional view illustrating the part of the fixing device according to the exemplary embodiment illustrated in FIG. 3 that is under no pressing force.

In this state, since the pressing unit 76 is not pressed against the heating roller 66 as illustrated in FIG. 5, the free end 118 of the pressing member 110 is at the largest angle with respect to the fixed portion 114 (see the state A illustrated in FIG. 4B). The tip 120 of the free end 118 of the pressing member 110 in this state is positioned farther from the seating surface 106 of the retaining body 100 than the top of the pressing-area-forming portion 104 of the retaining body 100. That is, the tip 120 of the free end 118 of the pressing member 110 is positioned closer to the heating roller 66 than the pressing-area-forming portion 104.

Referring now to FIGS. 3 and 7A, a behavior of the fixing device 36 that is observed when the pressing unit 76 is pressed with the normal pressing force will be described. When the pressing unit 76 is pressed with the normal pressing force, the position of the pressing unit 76 relative to the heating roller 66 is changed such that the pressing area 102 is formed by both the pressing-area-forming portion 104 and the pressing member 110. The fixing device 36 in this state fixes a toner image on a recording medium 130 as follows. First, a recording medium 130 to which a toner image has been transferred by the image forming device 14 is transported along the transport path 32 and is fed into the pressing area 102 in which the endless belt 72 is pressed against the heating roller 66 by the pressing unit 76. The pressing area 102 in this case is formed by the pressing-area-forming portion 104 and the pressing member 110. In this state, the heating roller 66 is rotated, and the endless belt 72 follows the rotation of the heating roller 66 and rotates along the outer periphery of the pressing unit 76, whereby the recording medium 130 is taken into the pressing area 102. The recording medium 130 whose leading end has been nipped between the heating roller 66 and the endless belt 72 is first pressed between the heating roller 66 and the pressing member 110 and then between the heating roller 66 and the pressing-area-forming portion 104. Thus, the toner image on the recording medium 130 is fixed.

In the above process, the pressing force applied to the heating roller 66 by the pressing-area-forming portion 104 is larger than the pressing force applied to the heating roller 66 by the pressing member 110. Specifically, the recording medium 130 is first pressed by the pressing member 110 provided on the side of the entrance 68 of the pressing area 102 and that exerts a relatively small pressing force, and is then pressed by the pressing-area-forming portion 104 that exerts a relatively large pressing force. In this process, the pressing member 110 on the side of the entrance 68 and the pressing-area-forming portion 104 on the side of the exit 70 are urged by an urging force exerted by the urging members provided to the pressing unit 76. The pressing member 110 is made of a plate that is bendable in accordance with the level of the pressing force, whereas the pressing-area-forming portion 104 is a part of the retaining body 100 and is difficult to deform. Therefore, the pressing-area-forming portion 104 on the side of the exit 70 exerts a larger pressing force, while the pressing member 110 on the side of the entrance 68 exerts a pressing force smaller than that exerted by the pressing-area-forming portion 104 on the side of the exit 70.

When the pressing unit 76 is not pressed against the heating roller 66, as illustrated in FIG. 5, the free end 118 of the pressing member 110 is at the largest angle with respect to the fixed portion 114 as described above. To cause the pressing unit 76 that is in such a state to be pressed toward the heating roller 66 with the normal pressing force, the pressing member 110 that is in the state illustrated in FIG. 5 where the free end 118 is at the largest angle (the state A illustrated in FIG. 4B) is pressed to such an extent as to be in the state illustrated in FIG. 3 where the free end 118 is at the smallest angle (the state C illustrated in FIG. 4B). The pressing member 110 thus deformed by the normal pressing force exerts a large repulsive force. Accordingly, a wider area is subjected to a large pressing force. Thus, the fixability is improved with a pressing member provided in the form of a metal leaf spring.

Referring now to FIGS. 6 and 7B, a behavior of the fixing device 36 that is observed when the pressing unit 76 is pressed with the pressing force smaller than the normal pressing force will be described. When the pressing unit 76 is pressed with the smaller pressing force, the position of the pressing unit 76 relative to the heating roller 66 is changed such that the pressing-area-forming portion 104 is moved away from the heating roller 66 and the pressing area 102 is formed by only the pressing member 110. The fixing device 36 in this state fixes a toner image on a recording medium 130 as follows. First, a recording medium 130 to which a toner image has been transferred by the image forming device 14 is transported along the transport path 32 and is fed into the pressing area 102 in which the endless belt 72 is pressed against the heating roller 66 by the pressing unit 76. The pressing area 102 in this case is formed by only the pressing member 110. Note that the pressing member 110 presses the heating roller 66 with a repulsive force generated when the pressing member 110 is deformed under the pressing force. In this state, the heating roller 66 is rotated, and the endless belt 72 follows the rotation of the heating roller 66 and rotates along the outer periphery of the pressing unit 76, whereby the recording medium 130 is taken into the pressing area 102. The recording medium 130 whose leading end has been nipped between the heating roller 66 and the endless belt 72 is pressed by the heating roller 66 and the pressing member 110. Thus, the toner image on the recording medium 130 is fixed.

Even when the pressing unit 76 is pressed with the pressing force smaller than the normal pressing force, the pressing member 110 is deformed from the state illustrated in FIG. 5 (the state A illustrated in FIG. 4B) to the state illustrated in FIG. 6 (the state B illustrated in FIG. 4B). Therefore, the pressing member 110 exerts a repulsive force corresponding to the pressing force.

As described above, in the image forming apparatus 10 according to the exemplary embodiment, the pressing member 110 is made of a metal plate that is bent along a line extending in the longitudinal direction thereof, and the position of the tip 120 of the free end 118 of the pressing member 110 is determined by the level of the pressing force applied to the pressing member 110. Hence, even when the pressing force for forming the pressing area 102 is changed by moving the pressing unit 76 relative to the heating roller 66, the pressing unit 76 is prevented from being deformed with the rotation of the heating roller 66 and the endless belt 72 and being taken into the nip between the pressing-area-forming portion 104 and the heating roller 66.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing device comprising:

a heating unit;

an endless belt body that rotates by following rotation of the heating unit; and a pressing unit that faces the heating unit with the endless belt body interposed between the pressing unit and the heating unit, the pressing unit including a retaining body that retains the endless belt body while allowing the endless belt body to rotate;

a first pressing-area-forming portion that is a part of the retaining body;

a pressing member that is provided on an upstream side of the retaining body with respect to the first pressing-area-forming portion in a direction of rotation of the endless belt body, the pressing member being made of a metal plate that is bent along a line extending in a longitudinal direction of the plate; and a second pressing-area-forming portion that is provided on the upstream side of the retaining body with respect to the pressing member in a direction of rotation of the endless belt body, wherein the pressing unit is movable relative to the heating unit between two positions, including a position where a pressing area is formed when the pressing unit is pressed toward the heating unit by the first pressing-area-forming portion, second pressing-area-forming portion and the pressing member and a position where the pressing area is formed by the pressing member only.

2. The fixing device according to claim 1, wherein the pressing member is directly attached to a seating surface of the retaining body.

3. The fixing device according to claim 1, wherein a portion of the pressing member that faces the heating unit is a free end that is movable in accordance with a level of a pressing force with which the pressing unit is pressed toward the heating unit, and wherein, in a state where the pressing member is free of the pressing force, a tip of the free end of the pressing member is positioned closer to the heating unit than the pressing-area-forming portion.

4. The fixing device according to claim 1, wherein the pressing member includes a bent portion at which the pressing member is bent;

a fixed portion extending on one side of the pressing member with respect to the bent portion and fixed to the retaining body; and a free end extending on another side of the pressing member with respect to the bent portion and being turnable on the bent portion in accordance with a level of a pressing force with which the pressing unit is pressed toward the heating unit, and wherein the pressing member has a plurality of grooves each extending from an end of the fixed portion to a position at a certain distance from a tip of the free end.

5. An image forming apparatus comprising the fixing device according to claim 1.

* * * * *